US006762352B2

(12) United States Patent
Liu

(10) Patent No.: US 6,762,352 B2
(45) Date of Patent: Jul. 13, 2004

(54) CONTROL MECHANISM FOR A CRYSTAL BALL

(76) Inventor: Jack Liu, 3F., 200, Xin-Yi Rd., Sec. 3, Taipei (TW), 106

( * ) Notice: Subject to any disclaimer, the term of this patent is extended or adjusted under 35 U.S.C. 154(b) by 0 days.

(21) Appl. No.: 10/299,803

(22) Filed: Nov. 20, 2002

(65) Prior Publication Data

US 2004/0094012 A1 May 20, 2004

(51) Int. Cl.[7] ..... G10F 1/06
(52) U.S. Cl. ..... 84/94.1
(58) Field of Search ..... 84/94.1, 94.2, 84/95.1, 95.2

(56) References Cited

U.S. PATENT DOCUMENTS 5,339,923 A * 8/1994 Chen ..... 185/39
5,510,569 A * 4/1996 Liu ..... 84/95.1
5,510,570 A * 4/1996 Liu ..... 84/95.2
6,038,798 A * 3/2000 Liu ..... 40/411

* cited by examiner

*Primary Examiner*—Jeffrey W. Donels

(74) *Attorney, Agent, or Firm*—Dennison, Schultz, Dougherty & MacDonald

(57) ABSTRACT

This invention provides a music/light synchronous control mechanism, comprising an overhead platform on a music bell, wherein said overhead platform has the first gear set driven by the shaft of said music bell, the second gear set driven by the spur gear in a music tumbler, a control mechanism, and a light contact switch mechanism. With the mechanic structure, this invention can control music and light to start/end them synchronously.

2 Claims, 7 Drawing Sheets

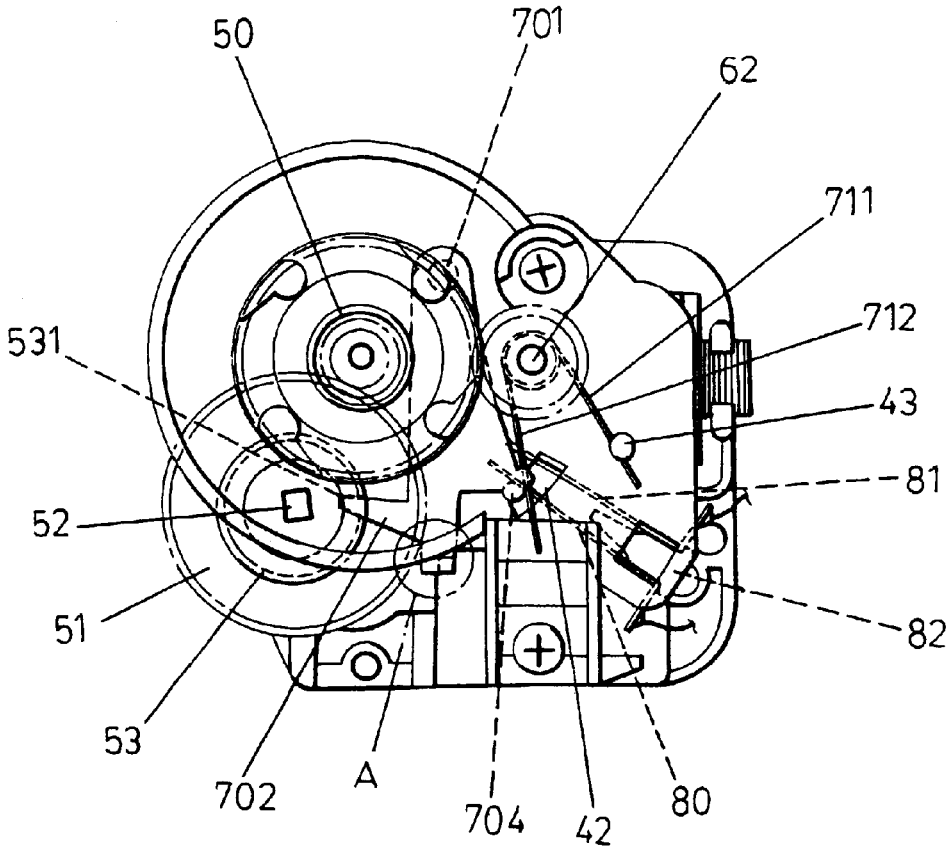
*Fig. 6*
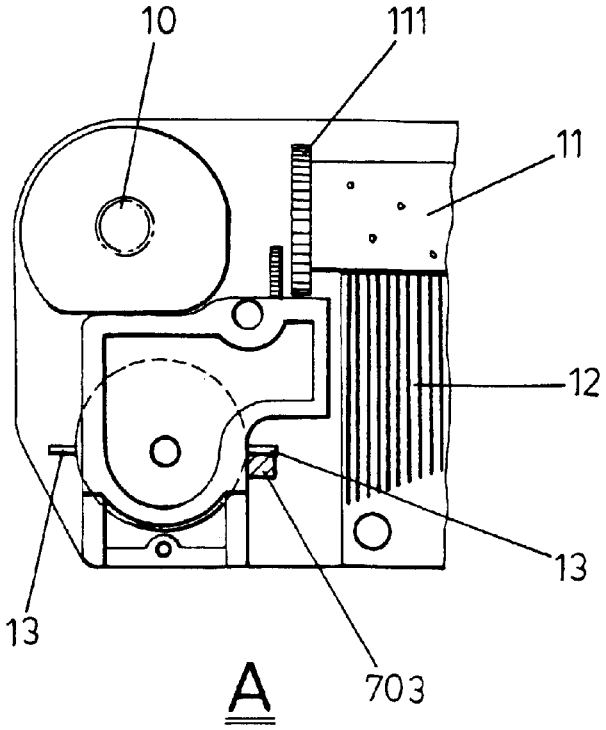

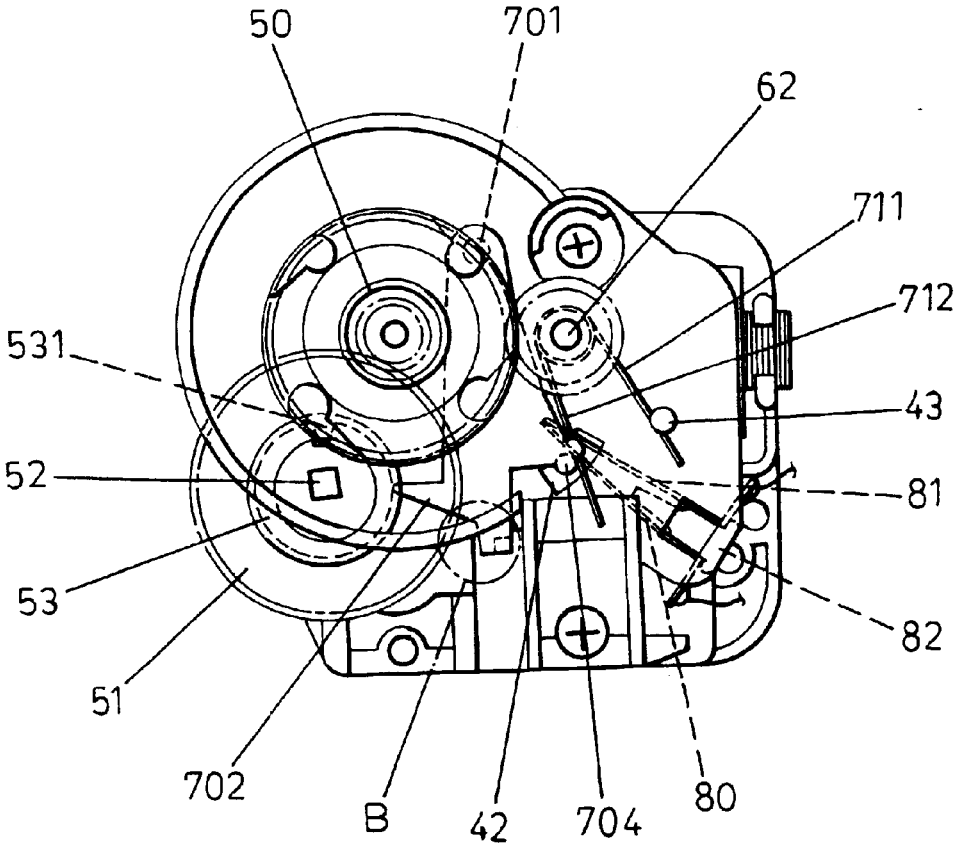
*Fig. 7*
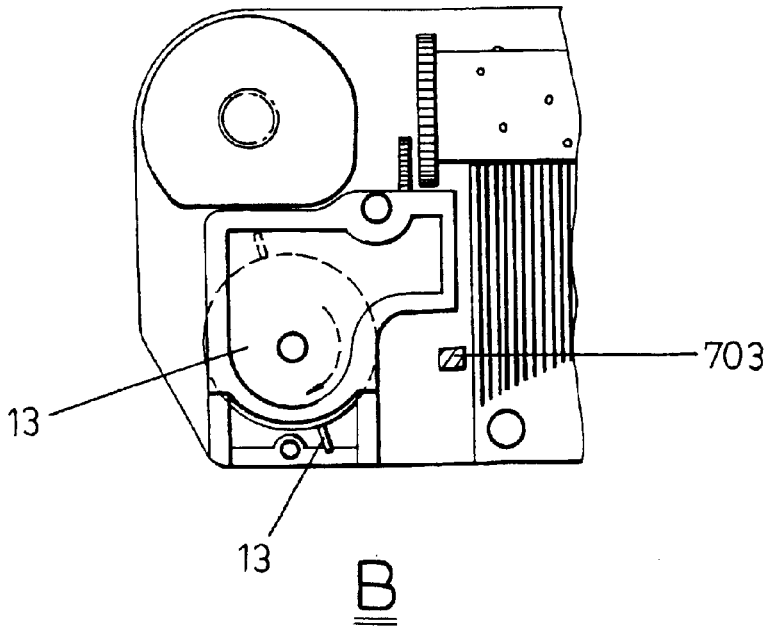

CONTROL MECHANISM FOR A CRYSTAL BALL

FIELD OF INVENTION

This invention is related to an improved decorative crystal ball structure, in particular a new crystal ball structure that has a music/light synchronous control mechanism, which controls the rhythm from a music bell and a decorative light through a mechanical drive synchronously.

BACKGROUND OF INVENTION

Filled with liquid, a decorative crystal ball in home or office can highlight the models (trees, houses, castles, and characters) inside the crystal ball due to its convex effect.

Usually, the chassis of a crystal ball has a music mechanism, which can play music when its clockwork spring is fastened manually. In order to enhance the decorative effect, a light mechanism may also be mounted in the crystal ball to attain aural/visual effect at the same time.

Furthermore, a Voice IC may be devised in the crystal ball to synchronize the music/light mechanisms. Though music/light synchronization may be achieved with the Voice IC, the Voice IC has two obvious shortcomings:

High cost and high failure rate, resulting in high cost of the crystal ball;

The Voice IC cannot distinguish the type and origin of the music. Though the Voice IC should turn on the light according to the music from the music mechanism in design, it may actually be triggered by any sound source (e.g., TV or home audio system). Thus the music/light synchronization may be destroyed.

In consideration of above shortcomings, the inventor deems a mechanism for music/light synchronization that is better than the above Voice IC approach. With years of experience in crystal ball design and actual development and tests, the inventor provides a music/light synchronous control mechanism.

SUMMARY OF INVENTION

The main purpose of this invention is to provide a music/light synchronous control mechanism, which controls music and light from start to finish synchronously.

Another purpose of this invention is to provide a music/light synchronous control mechanism to attain music/light synchronization for above crystal ball and eliminate unexpected ignition of the light in the crystal ball.

Another purpose of this invention is to provide a music/light synchronous control mechanism, which substitutes the legacy Voice IC with an accurate and reliable structure to synchronize music/light for above crystal ball and decrease the cost of the crystal ball significantly.

The foregoing and other technical contents of the invention can be further realized with the drawings and detailed description of the preferred embodiment.

BRIEF DESCRIPTION OF DRAWINGS

FIG. 6 is a plan view of this invention in static state;

FIG. 7 is a plan view of this invention in dynamic state.

DETAILED DESCRIPTIONS OF EMBODIMENTS

Figure 1:
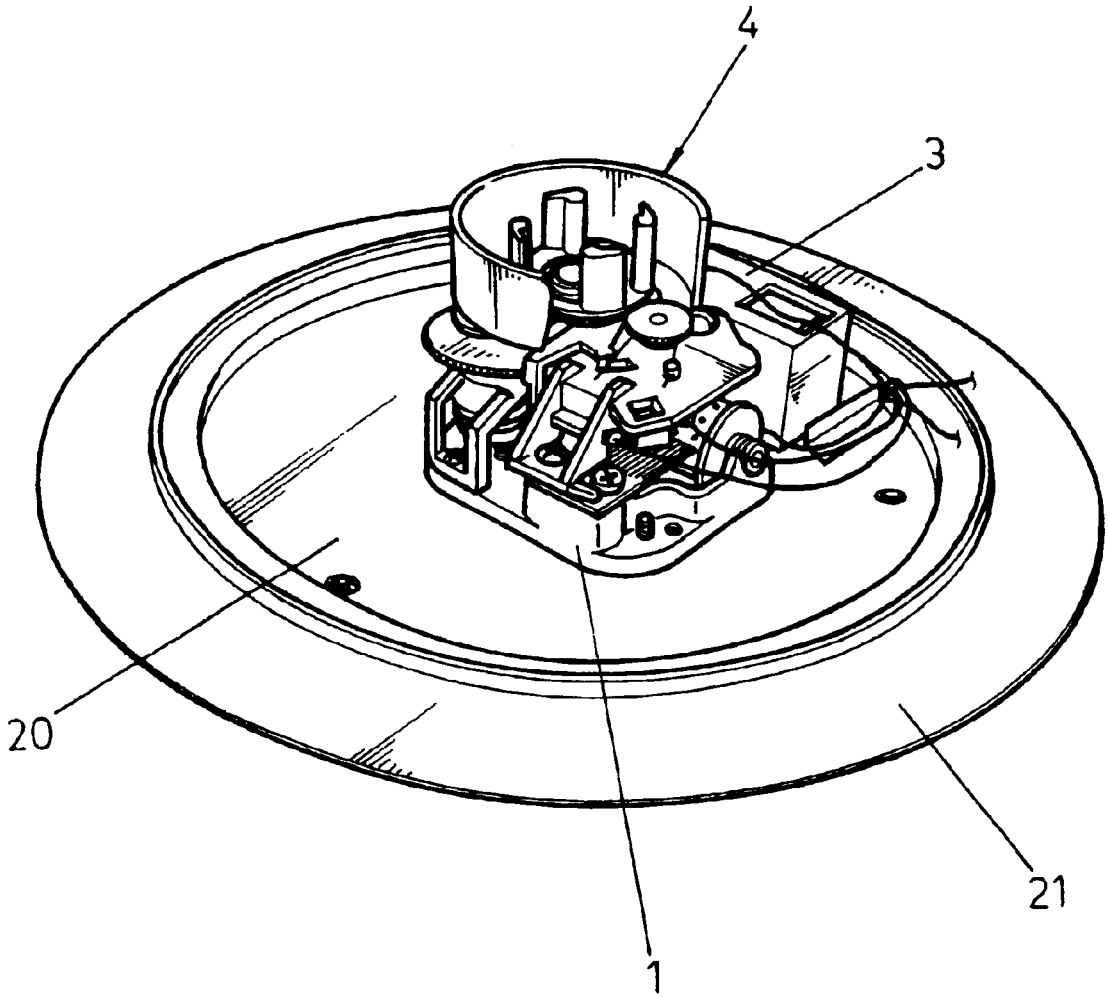
FIG. 1 is a 3D view of this invention.
Figure 2:
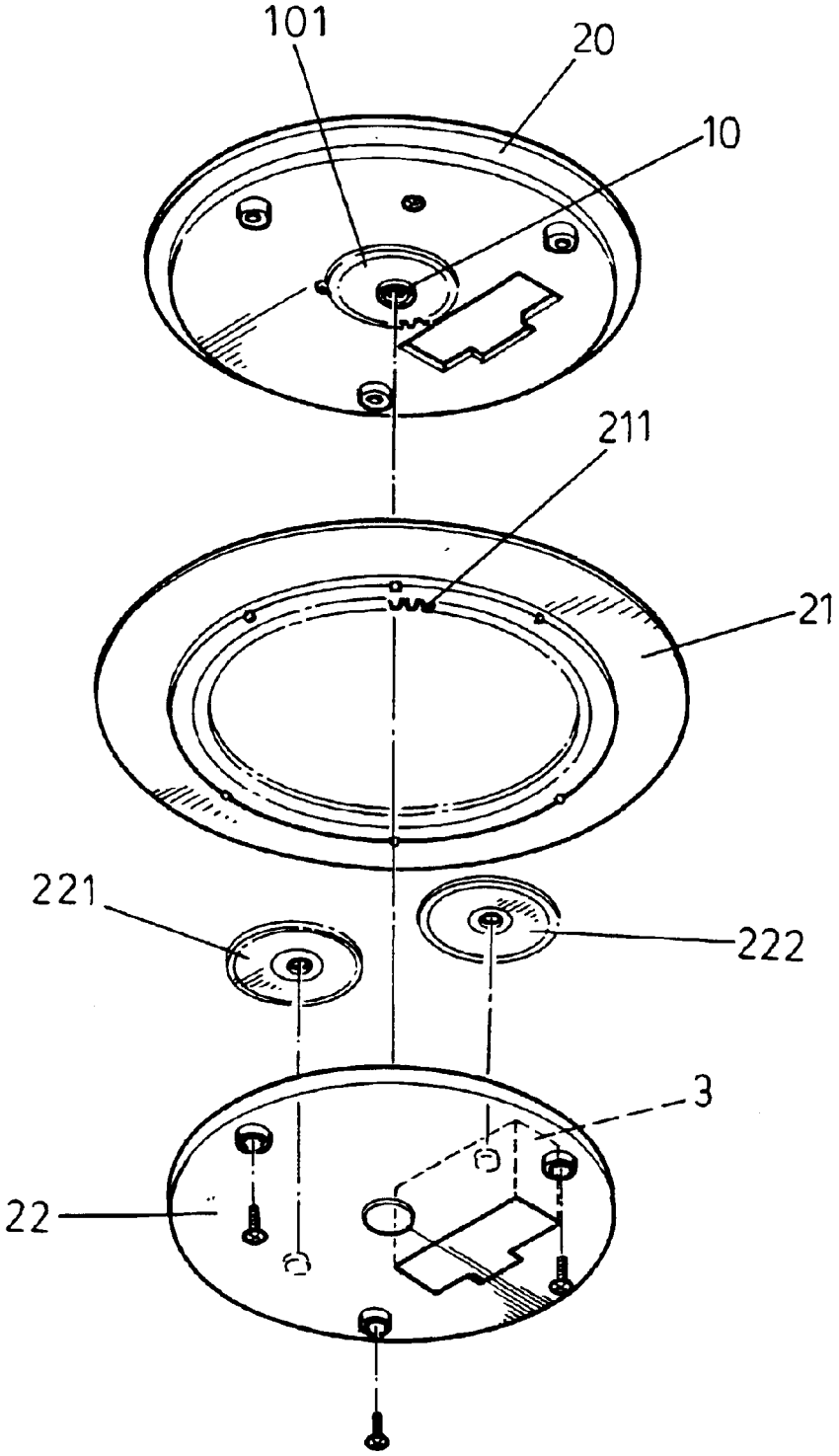
FIG. 2 is a 3D exploded view of the chassis and the seat of this invention.
Figure 3:
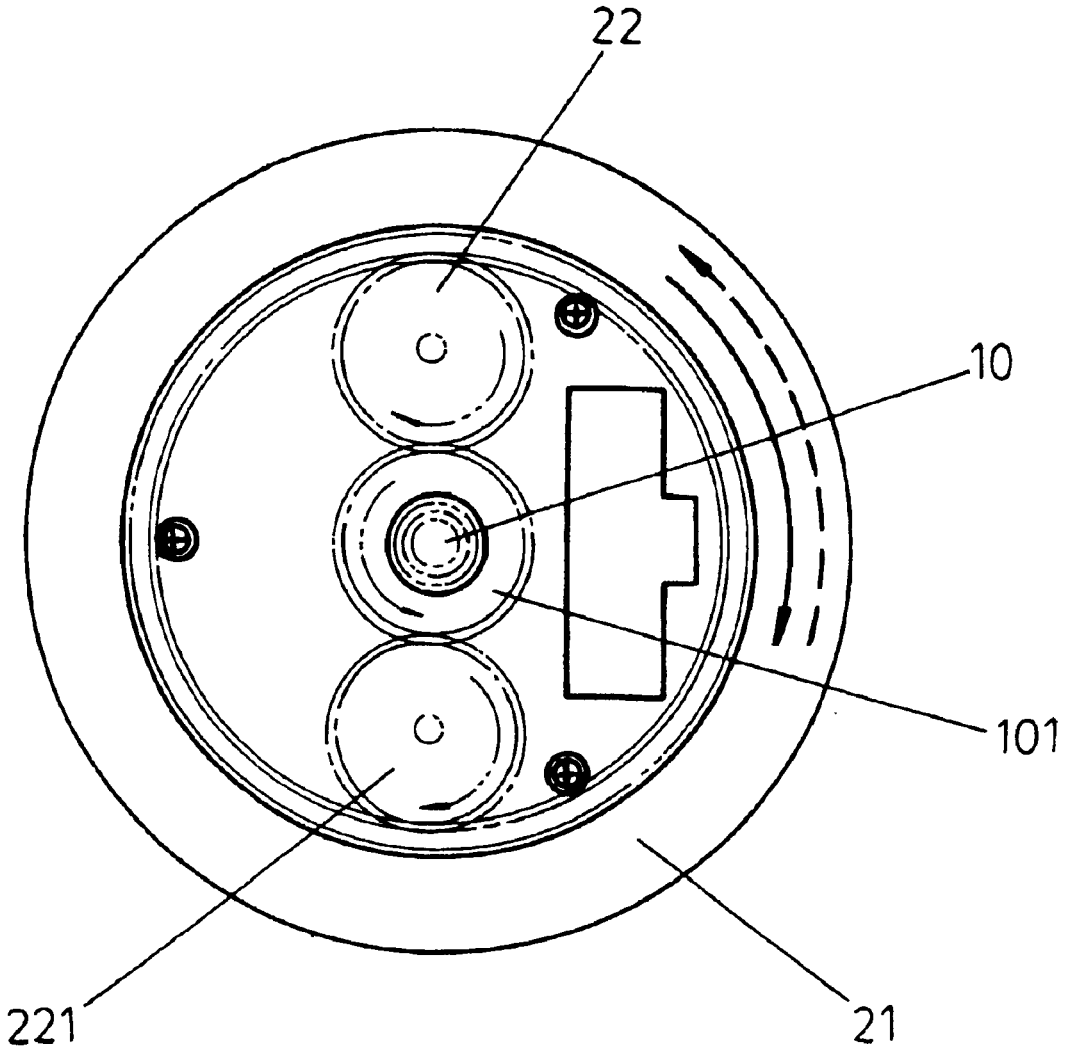
FIG. 3 is an abridged general view of the action to fasten the clockwork spring.
Figure 4:
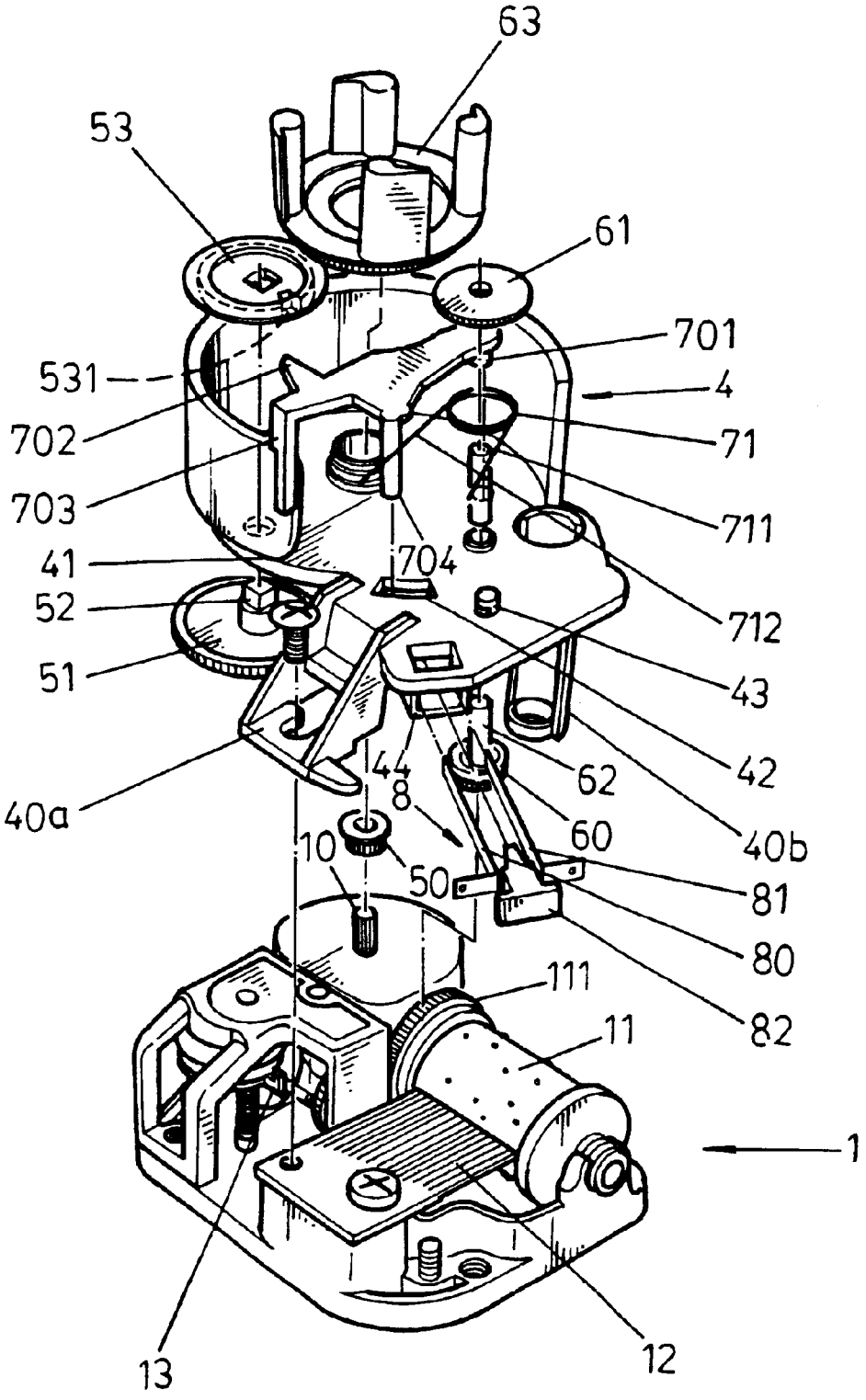
FIG. 4 is a 3D exploded view of this invention.

Referring now to FIG. 1, the music bell 1 is mounted on the chassis 20, and a battery case 3 for delivering power to the light is mounted adjacent to the music bell 1, and the chassis 20 has a turn-plate 21 that can be turned manually. Referring to FIG. 2 to FIG. 4, the turn-plate 21 has an internal toothed ring 211, which drives two drive gears 221, 222 on the seat 22 below the chassis 20 and then a drive gear 101 on the shaft 10 of the music bell 1. Thus the shaft 10 of the music bell 1 revolves and fastens the clockwork spring. When the clockwork spring is released, it will drive the shaft 10 of the music bell 1 and the tumbler 11 of the music bell 1, and then the tumbler 11 will play a piece of pleasure music under the strikes of a reed 12.

Figure 5:
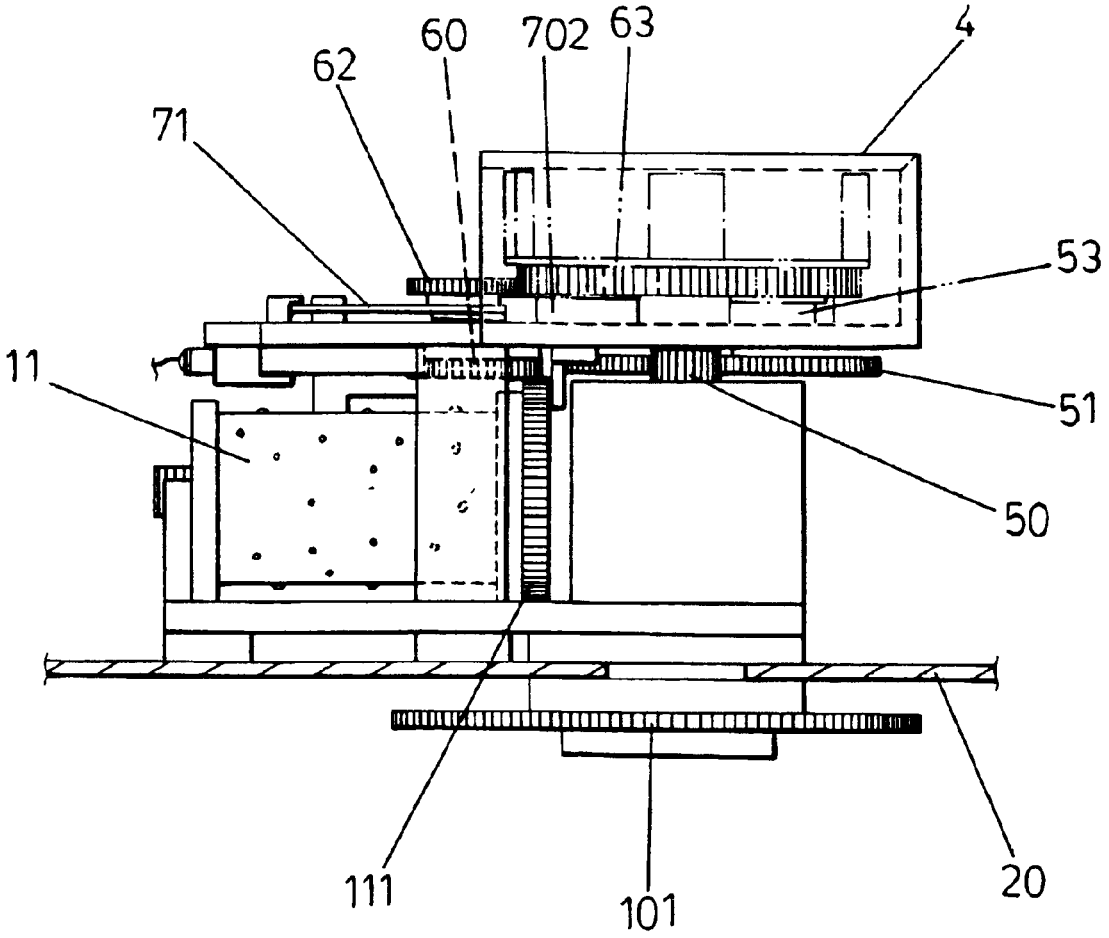
FIG. 5 is a drive abridged general view of this invention.

Referring to FIG. 4 and FIG. 5, an overhead platform 4 is fixed over the music bell 1 with its supports 40*a*, 40*b*. As described above, the revolving force generated by the released clockwork spring of the music bell 1 will be transferred upward through the first gear set 5 driven by the shaft 10 and the second gear set 6 driven by the spur gear 111 of the tumbler 11.

The second gear set 6 driven by the spur gear 111 comprises a coronal gear 60 under the overhead platform 4 and the coronal gear 60 is geared to the spur gear 111, a drive gear 61 aligning with coronal gear 60 on the overhead platform 4, a shaft 62 passing through the overhead platform 4 and coronal gear 60 and drive gear 61, and a 4-claw driving part 63 coupled with drive gear 61 and further transfer the revolving force upward to drive the thematic decorations in the crystal ball to revolve. However, in the alternative embodiments, the thematic decorations in the crystal ball are static, thus said 4-claw driving part 63 can be omitted.

The first gear set 5 driven by shaft 10 comprises a drive gear 50 on the shaft 10, a driven gear 51 under the overhead platform 4 and geared to the drive gear 50. The driven gear 51 passes through the overhead platform 4 via a square shaft 52 and is fixed to a blocking plate 52 that has a notch 531.

A control mechanism 7 comprises an activating element 70 and a torsion spring 71; wherein the activating element 70 further comprises a shaft 701 fixed on the overhead platform 4, a horizontal V-shape dowel 702 that can be coupled with the notch 531 of the blocking plate 53, the first vertical blocking pole 703 across the side edge 41 of the overhead platform 4, and the second vertical blocking pole 703 across the preset notch 42 on the overhead platform. The torsion spring 71 is fitted on the shaft 62 of drive gear 61 of the second gear set 6 and takes the shaft 62 and includes a central axis along the shaft. The first leg 711 of the torsion spring 71 props on the interior side of a preset locating piece 43 on the overhead platform 4, and the second leg 712 of the torsion spring 71 props on the exterior side of the second vertical blocking pole 704 of said activating element 70. Therefore, the torsion spring 71 pushes the activating element 70 to the far left side of the preset notch 42 on the overhead platform 4.

A light contact switch mechanism 8 comprises two L-shape conducting strips 80, 81 separated by a locating dowel 82 inserted in a square groove 44 reserved on the overhead platform 4; wherein the left conducting strip 80 on the exterior side of the second vertical blocking pole 704.

Referring to FIG. 6, the horizontal V-shape dowel 702 on the activating element 70 is inserted the notch 531 of the blocking plate 53 when above components are assembled together, and the second vertical blocking pole 704 on the activating element 70 is pulled to the far left end of the notch 42 under the tensile force of the torsion spring 71. In that state, the left conductive strip 80 propping the exterior side of the second vertical blocking pole 704 and the right conductive strip 81 are separated to each other. Thus the circuit is open.

Referring to FIG. 7, the clockwork spring drives the shaft 10 of the music bell 1 to revolve when it is fastened manually and then released.

The shaft 10 in turn drives the drive gear 50 and the driven gear 51 to revolve. In that way, the V-shape dowel 702 inserted in the notch 531 on the blocking plate 53 is propped out, i.e., the activating element 70 shifts toward right around the shaft 701 fixed on the overhead platform 4 and pushes the left conductive strip 80 propping on the exterior side of the second vertical blocking pole 704 toward the right conductive strip 81. When the two conductive strips 80, 81 contact with each other, the circuit is closed and the light is turned on. At the same time, the clockwork spring also drives the tumbler 11 on the music bell 1 to revolve and play a piece of pleasure music under the strikes of the reed 12.

When said blocking plate 53 revolves for a cycle, the V-shape dowel 702 propped out of the notch 531 will be reinserted into the notch 531 by the activating element 70 under the driving force of torsion spring 71, and the left conductive strip 80 propping on the exterior side of the second vertical blocking pole 704 is separated from the right conductive strip 81 again, thus the circuit is open again, and the entire mechanism will return to the static state shown in FIG. 6.

However, though the light is shut off now, the mechanical energy of the music may not be released completely and the music may still be on. In that case, the first vertical blocking pole 703 across the side edge 41 of the overhead platform 4 will act to stop the music, in order to synchronize music/light accurately.

It is a common knowledge that when the speed regulator of a music box is blocked, the music will stop at once. Referring to FIG. 6A and FIG. 7B, the first vertical blocking pole 703 across the side edge 41 of the overhead platform 4 stays at the far left position and block the speed regulator 13 (as shown in FIG. 6A) when the activating element 70 is in static state shown in FIG. 6; however, the first vertical blocking pole 703 will shift toward right and leave the original blocking position (as shown in FIG. 7B) when the activating element 70 is in dynamic state shown in FIG. 7. Therefore, when the blocking plate 53 revolves for a cycle and the circuit is shut off, the first vertical blocking pole 703 will move left and block the speed regulator 13 under the pushing force of the activating element 70, which is in turn driven by the torsion spring 71. Thus the music will be stopped at once, and the music/light synchronization is achieved.

In conclusion, with the mechanical structure, this invention can implement synchronization between the music/light in said crystal ball accurately at a low cost.

What is claimed is:

1. A music/light synchronous control mechanism, comprising:

an overhead platform fixed over a music bell with its two supports;

the first gear set driven by the shaft of the music bell, comprising a drive gear on said shaft, a driven gear under said overhead platform and geared to said drive gear; wherein said driven gear passes through said overhead platform via a square shaft and is fixed to a blocking plate that has a notch;

the second gear set driven by a spur gear in the tumbler of said music bell, comprising a coronal gear under the overhead platform and geared to said spur gear, a drive gear aligning with said coronal gear on said overhead platform, a shaft passing through said overhead platform and said coronal gear and said drive gear, and a control mechanism comprising an activating element and a torsion spring; wherein said activating element further comprises a shaft fixed on said overhead platform, a horizontal dowel that can be coupled with the notch of said blocking plate, the first vertical blocking pole across the side edge of said overhead platform, and the second vertical blocking pole across a preset notch on said overhead platform; wherein said torsion spring is fitted on the shaft of said drive gear of said second gear set and takes said shaft as its central axis; wherein the first lag of said torsion spring props on the interior side of a preset locating piece on said overhead platform, and the second leg of said torsion spring props on the exterior side of the second vertical blocking pole of said activating element; in that way, said torsion spring pushes said activating element to the far left side of said preset notch on said overhead platform;

a light contact switch mechanism comprises two L-shape conducting strips separated from each other by a locating dowel inserted in a square groove reserved on said overhead platform; wherein said conducting strip on the left props on the exterior side of said second vertical blocking pole.

2. The music/light synchronous control mechanism according to claim 1, wherein said second gear set driven by said spur gear in the tumbler of said music bell comprises a coronal gear under said overhead platform and geared to said spur gear, a drive gear aligning with said coronal gear on said overhead platform, a shaft passing through said overhead platform and said coronal gear and said drive gear, and driving part geared to said drive gear.

* * * * *